United States Patent [19]

Appell et al.

[11] 3,989,480

[45] Nov. 2, 1976

[54] DECOMPOSITION OF CARBOHYDRATE WASTES

[75] Inventors: Herbert R. Appell, Monroeville; Peter Pantages, Pittsburgh, both of Pa.

[73] Assignee: The United States of America as represented by the United States Energy Research and Development Administration, Washington, D.C.

[22] Filed: Mar. 25, 1976

[21] Appl. No.: 670,479

Related U.S. Application Data

[63] Continuation of Ser. No. 503,544, Sept. 5, 1974, abandoned.

[52] U.S. Cl. ..... 48/209; 252/373

[51] Int. Cl.[2] ..... C10J 3/00

[58] Field of Search ..... 48/197 R, 209; 201/2.5, 201/25; 252/373, 474; 423/651, 415

[56] References Cited

UNITED STATES PATENTS

| | | | |
|---|---|---|---|
| 3,252,773 | 5/1966 | Solomon et al. | 48/209 UX |
| 3,515,514 | 6/1970 | Holmes et al. | 252/373 X |
| 3,541,729 | 11/1970 | Dantowitz | 252/373 X |
| 3,556,751 | 1/1971 | Slater et al. | 48/209 UX |
| 3,578,423 | 5/1971 | Falbe et al. | 48/197 R |
| 3,698,881 | 10/1972 | White | 48/209 |
| 3,708,270 | 1/1973 | Birk et al. | 48/209 X |
| 3,743,662 | 7/1973 | Eurhigs et al. | 252/474 X |
| 3,759,677 | 9/1973 | White | 48/209 |
| 3,850,588 | 11/1974 | White | 48/209 |

*Primary Examiner*—Morris O. Wolk
*Assistant Examiner*—Michael S. Marcus
*Attorney, Agent, or Firm*—John A. Horan; Arthur A. Churm

[57] ABSTRACT

Carbohydrate waste materials are decomposed to form a gaseous fuel product by contacting them with a transition metal catalyst at elevated temperature substantially in the absence of water.

8 Claims, No Drawings

DECOMPOSITION OF CARBOHYDRATE WASTES

This is a continuation of application Ser. No. 503,544, filed Sept. 5, 1974, now abandoned.

Carbohydrate-containing waste materials are conventionally decomposed by pyrolysis, resulting in formation of large amounts of char and water and relatively small yields of fuel gases. Fermentation is also conventionally employed, but requires large holding tanks, long contact times and results in large residues.

It has now been found, according to the invention, that carbohydrate waste materials may be decomposed by contacting them at elevated temperature with a transition metal catalyst. This process provides higher yields of desirable fuel gases, i.e., hydrogen and carbon monoxide, as well as lower yields of undesirable by-products such as char and aqueous effluents containing partially decomposed carbohydrates.

The waste materials that may be treated according to the process of the invention encompass a wide variety of carbohydrate-containing materials. They may consist essentially of carbohydrates, e.g., sugars, starches and cellulose, or they may consist of materials containing mixtures or combinations of carbohydrates with other chemical entities, e.g., lignocellulose, particularly wood. Other materials that may be treated include sewage sludge, corn cobs, food wastes, manure, straw and other plant residues.

The process of the invention may be conducted in various ways, depending on the nature of the waste material. If the waste material is liquid, water-soluble, or is convertible to liquid or soluble form, it may be passed over a bed of the catalyst maintained at the required temperature. If it is in a solid form, e.g., sawdust, it may be impregnated with a solution of a compound of the catalytic metal that is readily converted to the metal on heating. The impregnated waste is then exposed to the required reaction conditions by conventional means, e.g., it may be dropped through a heated tube of sufficient length to permit the decomposition reaction to take place.

Suitable reaction temperature will generally range from about 400° to 900° C, with about 500° to 700° C generally being preferred. Ordinarily, the process will be conducted at atmospheric pressure, although pressures above or below atmospheric may be used.

The preferred catalysts are nickel and cobalt because of their high activity and availability. However, metals below nickel and cobalt in the periodic table, i.e., rhodium, iridium, palladium and platinum may also be used, although they are considerably more costly. Alloys, such as Monel (copper-nickel) or Nichrome (nickel-iron-chromium), may also be used.

The catalytic metals may be employed in a variety of forms, depending on the nature of the waste material being treated. Where a bed of the catalyst is employed the catalyst may be in the form of turnings, or in the form of particles, generally of a mesh size of about 1/16 to ⅜ inch. These may consist of the catalytic metal per se, or of an alloy of the metal. The catalytic metal may also be employed on a suitable support such as alpha alumina, alundum or other low surface area thermally stable material. The waste materials may be impregnated to metal contents of a few hundredths of a percent to 10 percent. The preferred range is 0.2 percent to 5 percent.

As mentioned above, the catalyst may also be employed in the form of a solution of a compound of the catalytic metal that is converted to the metal at the temperature of the decomposition reaction. Examples of such compounds are cobalt carbonyl, nickel carbonyl, nickel formate and palladium chloride.

The gaseous products of the process of the invention consist largely of hydrogen and carbon monoxide, with minor amounts of methane, carbon dioxide, ethane, ethylene and nitrogen. These gases may be collected by means of a conventional process such as water displacement. Separation of the fuel gases, i.e., hydrogen and carbon monoxide, from other gaseous products is also by conventional means such as solvent scrubbing.

The residue, which consists largely of the catalytic metal and some carbonaceous by-product, is treated by conventional procedures for recovery and reuse of the catalytic metal. Such procedures include acid extraction and treatment with carbon monoxide under pressure to generate the carbonyls.

The invention will be more specifically illustrated by the following examples.

EXAMPLE 1

A 45.5 percent aqueous solution of glucose was dropped onto a bed of catalytic metal particles (mesh size ¼ inch) in a heat resistant glass tube positioned in an electrically heated vertical furnace. The temperature was maintained at 600° C and the pressure was atmospheric. The particular metal employed and the results, i.e., the volume of gas produced and the extent of gasification of the carbon and hydrogen in the glucose, are given in Table 1.

Table 1

| Metal | ml gas/g glucose | Gas composition, percent H | $CH_4$ | CO | $CO_2$ | Gasification % of H | % of C |
|---|---|---|---|---|---|---|---|
| Stainless steel | 295 | 36 | 6 | 35 | 19 | 19 | 23 |
| Nichrome | 495 | 26 | 8 | 51 | 9 | 30 | 47 |
| Monel turnings | 990 | 48 | 3 | 43 | 6 | 71 | 69 |
| Nickel turnings | 1,062 | 50 | 2 | 38 | 10 | 78 | 72 |

EXAMPLE 2

Sawdust from softwoods was impregnated with a 5% solution of cobalt carbonyl in petroleum ether to give a concentration of 2.5% cobalt on the sawdust. The sawdust was then dropped into a heated tube 12 inches in length containing an inert support. The support consisted of a ceramic saddle and served to retain the sawdust long enough for gasification to take place. Various temperatures were employed, with the resulting gas yields shown in Table 2.

Table 2

| Temperature, ° C | ml gas/gram sawdust |
|---|---|
| 550 | 953 |
| 575 | 1,012 |
| 600 | 1,108 |
| 625 | 1,716 |

EXAMPLE 3

In the absence of a catalytic metal softwood sawdust gave the results shown in Table 3 when the procedure and apparatus used in Example 2 was employed.

Table 3

| Temperature °C | ml gas/ g. wood | Gas Composition (%) H | $CH_4$ | CO | $CO_2$ | Gasification % of H | % of C |
|---|---|---|---|---|---|---|---|
| 550 | 341 | 9 | 14 | 53 | 15 | 15 | 27 |
| 575 | 374 | 12 | 14 | 50 | 15 | 18 | 26 |
| 600 | 459 | 18 | 14 | 44 | 15 | 27 | 34 |
| 625 | 560 | 22 | 15 | 41 | 15 | 35 | 39 |
| 650 | 659 | 26 | 15 | 37 | 15 | N.D. | N.D. |

N.D. = not determined.

EXAMPLE 4

The effectiveness of the transition metal catalysts, even in small amounts, is illustrated by the improved results in Table 4, where the softwood contained 0.25% cobalt, over the uncatalyzed results in Example 3.

Table 4

| Temperature °C | ml gas/ ml wood | Gas Composition (%) H | $CH_4$ | CO | $CO_2$ | Gasification % of H | % of C |
|---|---|---|---|---|---|---|---|
| 550 | 534 | 31 | 10 | 33 | 20 | 34 | 45 |
| 575 | 703 | 39 | 9 | 32 | 18 | 49 | 41 |
| 600 | 775 | 39 | 8 | 33 | 15 | 49 | 44 |
| 625 | 841 | 40 | 8 | 32 | 15 | 60 | 50 |
| 650 | 973 | 43 | 8 | 36 | 11 | 73 | 54 |

EXAMPLE 5

The relative effectiveness of several metals for the decomposition of softwood sawdust by the procedures of the previous examples is shown in Table 5. The non-transition metal silver gave results no better than the absence of metal, whereas all of the transition metals gave significantly improved results even though present in low concentration.

Table 5

| Percent metal | Impregnating agent | ml gas/ ml wood | Gasification % of H | % of C |
|---|---|---|---|---|
| None | — | 593 | 36 | 44 |
| Ag, 0.25 | $AgNO_3$ | 594 | 41 | 42 |

Table 5-continued

| Percent metal | Impregnating agent | ml gas/ ml wood | Gasification % of H | % of C |
|---|---|---|---|---|
| Pd, 0.008 | $PdCl_2$ | 662 | 41 | 49 |
| Pd, .25 | $PdCl_2$ | 684 | 42 | 52 |
| Pt, 0.12 | $K_2PtCl_6$ | 724 | 45 | 54 |
| Co, 0.25 | $Co_2(CO)_8$ | 888 | 58 | 55 |

We claim:

1. A process, for decomposing carbohydrate waste materials to form a gaseous fuel product consisting essentially of impregnating the waste material with a nonaqueous solution of a catalytic metal from the group consisting of nickel, cobalt, rhodium, iridium, palladium platinum and alloys of copper-nickel and of nickel-iron-chromium and heating to a temperature of about 400° to 900° C. for a period of time sufficient to decompose a substantial portion of the carbohydrate to hydrogen and carbon monoxide in about equal proportions by volume.

2. The process of claim 1 in which the waste material consists essentially of a cellulosic material.

3. The process of claim 2 in which the cellulosic material is wood.

4. The process of claim 1 in which the catalytic metal is nickel or cobalt.

5. The process of claim 1 in which the catalytic metal is a copper-nickel alloy.

6. The process of claim 1 in which the temperature is about 500° to 700° C.

7. In a process for decomposing carbohydrate waste material substantially in the absence of water by heating to a temperature of 400° to 900° C. to produce about equal volumes of hydrogen and carbon monoxide gas, the improvement consisting essentially of impregnating said waste material with a nonaqueous solution of a catalytic metal from the group consisting of cobalt, nickel, rhodium, iridium, palladium, platinum and alloys of copper-nickel and of nickel-iron-chromium, prior to heating to said temperature.

8. The process of claim 7 wherein the catalytic metal is cobalt.

* * * * *